United States Patent [19]

Smeets et al.

[11] Patent Number: 4,836,825

[45] Date of Patent: Jun. 6, 1989

[54] AUTOMATIC DISPENSER AND COIN CHANGER

[75] Inventors: Jacques Smeets, Cerny; Marcel Dupuy, Issy les Moulineaux; Paul Rossi, Courcouronnes, all of France

[73] Assignee: Compagnie Generale D'Automatisme CGA-HBS, Paris, France

[21] Appl. No.: 141,163

[22] Filed: Jan. 6, 1988

[30] Foreign Application Priority Data

Jan. 6, 1987 [FR] France ..... 87 00050

[51] Int. Cl.[4] ..... G07D 1/06

[52] U.S. Cl. ..... 453/49; 453/2; 453/40; 453/57; 194/351

[58] Field of Search ..... 453/1, 2, 40, 49, 57; 221/82, 83; 194/202, 203, 351

[56] References Cited

U.S. PATENT DOCUMENTS 3,415,256 12/1968 Meloni ..... 453/40 X 4,347,924 9/1982 Hayashi et al. ..... 453/2

FOREIGN PATENT DOCUMENTS 646000 10/1984 Switzerland ..... 194/351

*Primary Examiner*—Joseph J. Rolla

*Assistant Examiner*—Mona C. Beegle

*Attorney, Agent, or Firm*—Sughrue, Mion, Zinn, Macpeak & Seas

[57] ABSTRACT

A coin recognizing selector (3) is followed by a buffer coin box (5) serving as a temporary store for newly inserted coins. The buffer has a stepping motor-indexable, bottomless and topless, circular loading magazine with P+2 radial cells bounded by radial walls, within a stationary cartridge. The cartridge has a bottom opening two magazine cells wide, equipped with a bolt (36) operable to either close off the opening completely or close off either its right or left side. N identical coin stores (6 to 11) are arranged coaxially one below the other to make change, are supplied from the buffer (5) and feed either a coin collection box (12) or a coin return tray (4) arranged in parallel beneath the storage decks. The bolts (36) are controlled to release coins from the stores to the coin box (12) or return tray (4), or from the buffer (5) to one of the stores (6 to 11), each store being assigned coins of a specific denomination.

5 Claims, 9 Drawing Sheets

FIG.5A
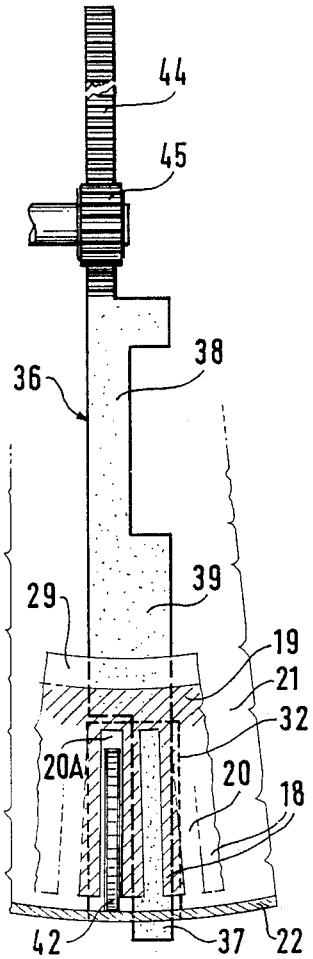
FIG.5B
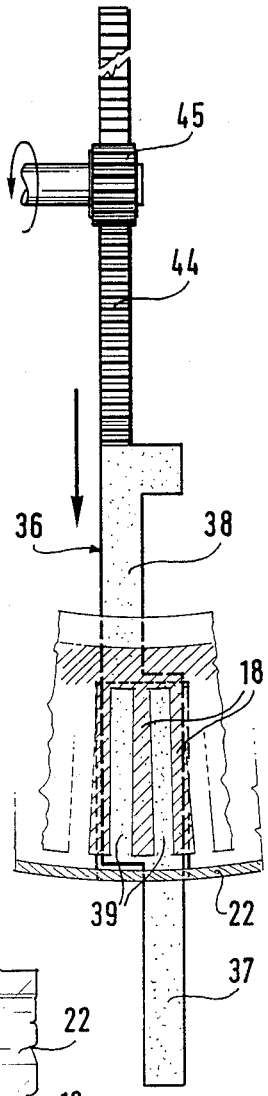
FIG.5C
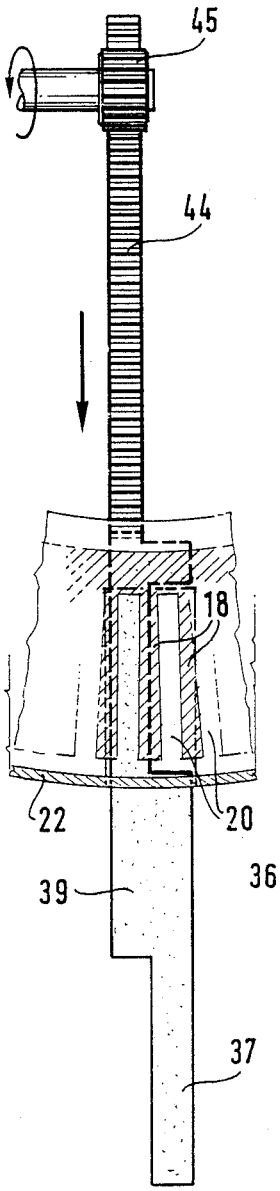
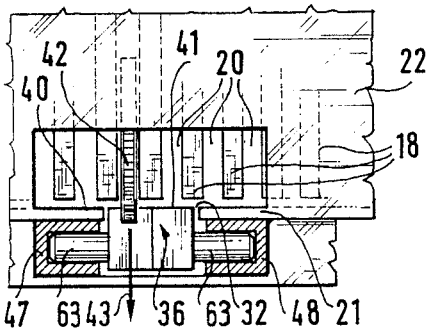
FIG.6

AUTOMATIC DISPENSER AND COIN CHANGER

This invention concerns an automatic dispenser able to return change in coins.

BACKGROUND OF THE INVENTION

Dispensers, also called vending machines, of various objects or tickets, such as transportation tickets, are generally known. They either require exact change or can make change. The latter type contain different stores for different coin categories ar denominations, the coins in the stores being supplied by the operator and the stores refilled, i.e. the missing coins replaced, when depleted. Experience has shown that, lacking very large-capacity, space-consuming stores, the supply of coins is quickly depleted and therefore requires frequent refilling.

SUMMARY OF THE INVENTION

It is the object of this invention to overcome this drawback by providing an automatic dispenser and coin changer comprising a single slot for inserting coins, followed by a chute to guide the coins to the entry to a selector, wherein are additionally provided a temporary storage coin box or buffer box followed by N coin stores beneath which are located a coin box and a coin return tray, the buffer box and each coin store having a bottomless and topless loading magazine, shaped as circular crown with a vertical axis, comprising P+2 (where P stands for coin capacity) radial cells bounded by radial, vertical walls, arranged in a stationary cartridge having at least a bottom and a circular side wall, the buffer and each coin store having a stepping motor to rotatively drive said loading magazine within each cartridge, the N stores being placed coaxially one below another beneath the buffer, the bottom of each cartridge being provided with a radial opening beneath the said cells, the said opening extending over a circular width corresponding to two cells of the said loading magazine, said openings in all the said cartridges being all vertically aligned on the same axis, each loading magazine motor stopping its associated magazine always in a position where two consecutive cells are located in front of said opening, the outlet of said selector being located in front of a first vertical alignment or column of cells of the buffer box and of the N stores enabling a coin to drop from said selector into the said coin return tray, through said openings, a second, consecutive vertical alignment or column of cells of the buffer box and stores enabling a coin to drop from said buffer into said coin box through said openings, said opening of each cartridge being equipped with a bolt equipped with a control motor enabling the bolt to assume a first position completely blocking the said opening, a second position blocking a portion of the said opening corresponding to said first column of cells and a third position blocking the other portion of said opening corresponding to said second column of cells, each cartridge comprising means for detecting the position of the loading magazine and the bolt, the dispensing unit as a whole further comprising electronic and computer control means controlling the loading magazine and bolt actuating motors and managing the buffer box, stores and coin box assembly.

Advantageously, each cartridge also comprises a top cover having an opening vertically aligned with said bottom opening.

According to another characteristic of the invention, the coin slot is followed by a shutter flap preceded by a first coin presence detector controlling the opening of the shutter and followed by a second detector, said first and second detectors serving to check the direction of coin passage.

Also claimed with the invention is a procedure for utilization of the dispenser, whereby all the coins inserted by the user and recognized and accepted by the selector, regardless of their category, are deposited one by one in consecutive cells of the buffer box, by successive, stepped rotation of the loading magazine in the cartridge of the buffer box, and whereby as soon as the displayed amount of the requested service or purchase is reached, the service or product is delivered, the due change is returned strictly from the different stores, the buffer box being emptied into the different stores, each store being assigned to handle a single category of coins.

DESCRIPTION OF THE DRAWINGS

One embodiment of the invention will now be described with reference to the appended drawings in which:

FIGS. 5A, 5B and 5C show the bolt for partly or completely blocking the bottom opening of a cartridge, in three distinct postions;

FIG. 6 is a partial cross section taken along line VI—VI of FIG. 3 showing the end of the bolt in the position represented in FIG. 5A;

DESCRIPTION OF THE PREFERRED EMBODIMENT

Figure 1:
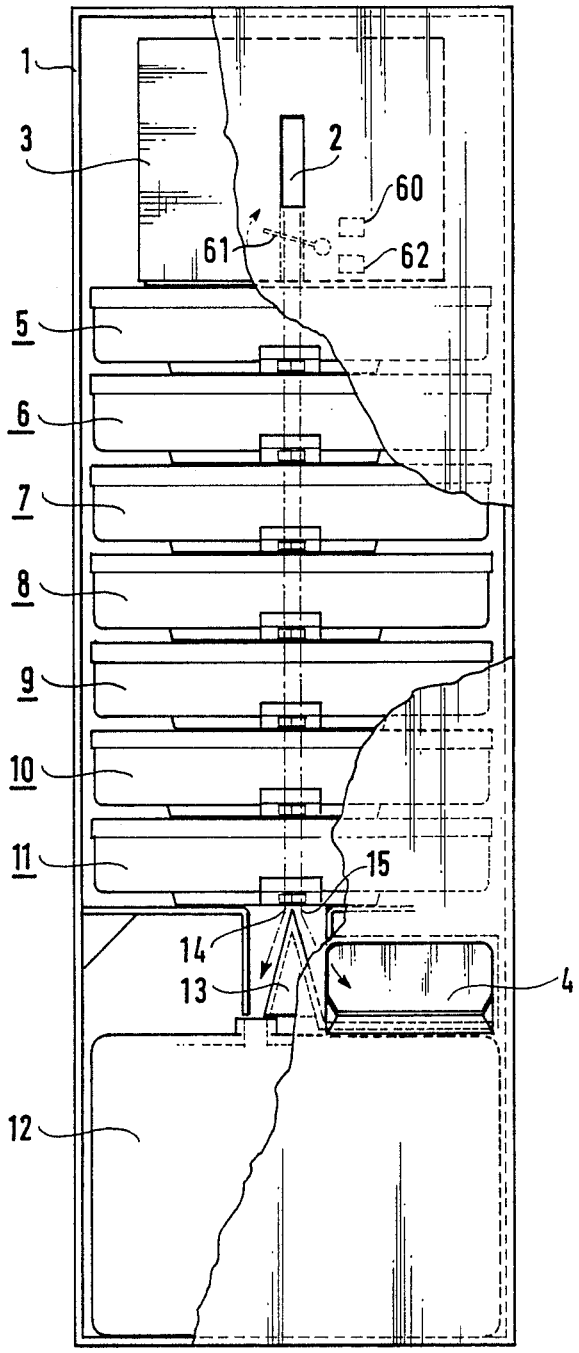
FIG. 1 is an overall schematic drawing of the coin handling portion of a dispenser according to the invention.

Referring first to FIG. 1, one can see a device making up the coin-handling portion of an automatic dispenser, such a dispenser being operable to dispense any type of product, a ticket for example. The front panel thereof contains operating instructions and various access keys or pushbuttons, display lights, etc., all things known in the prior art that are not strictly part of the coin handler, in other words not part of the device which receives the money from customers in payment for a desired service, accepts the cash and returns the change.

Accordingly, only the coin handler will be described hereinafter, with the understanding that the overall envelope or case 1 in which it is located can also enclose other parts of the dispenser.

The unit as a whole, then, is located in a case 1, which comprises a slot 2 for inserting coins, located in the top of the coin handler. There is only one such slot provided and it serves for all coins regardless of their value. A chute, omitted from the drawing, extends the slot and guides the inserted coins to the inlet of a selector 3 of a known type, operable to recognize and discriminate between different classes of coins. This selector is linked to control electronics for the dispenser as a whole. If a coin is not recognized by the selector 3, it drops immediately into a coin return tray 4 at the bottom of the coin handler.

Beneath the selector 3 is a temporary coin storage box or buffer box 5, and below the buffer 5, a series of N stores, of which there are six, referenced 6 to 11, in the example described.

The buffer 5 and the six stores 6 through 11 are identical and interchangeable. The buffer and stores being structurally identical, it will be appreciated that the subsequent figures described herein, i.e. 2 through 7, can represent any of these items.

The buffer and stores are circular magazines arranged in a coaxial stack.

Beneath the sixth store 11 are the coin return tray 4 on one hand and the coin collection box 12 on the other hand.

Figure 2:
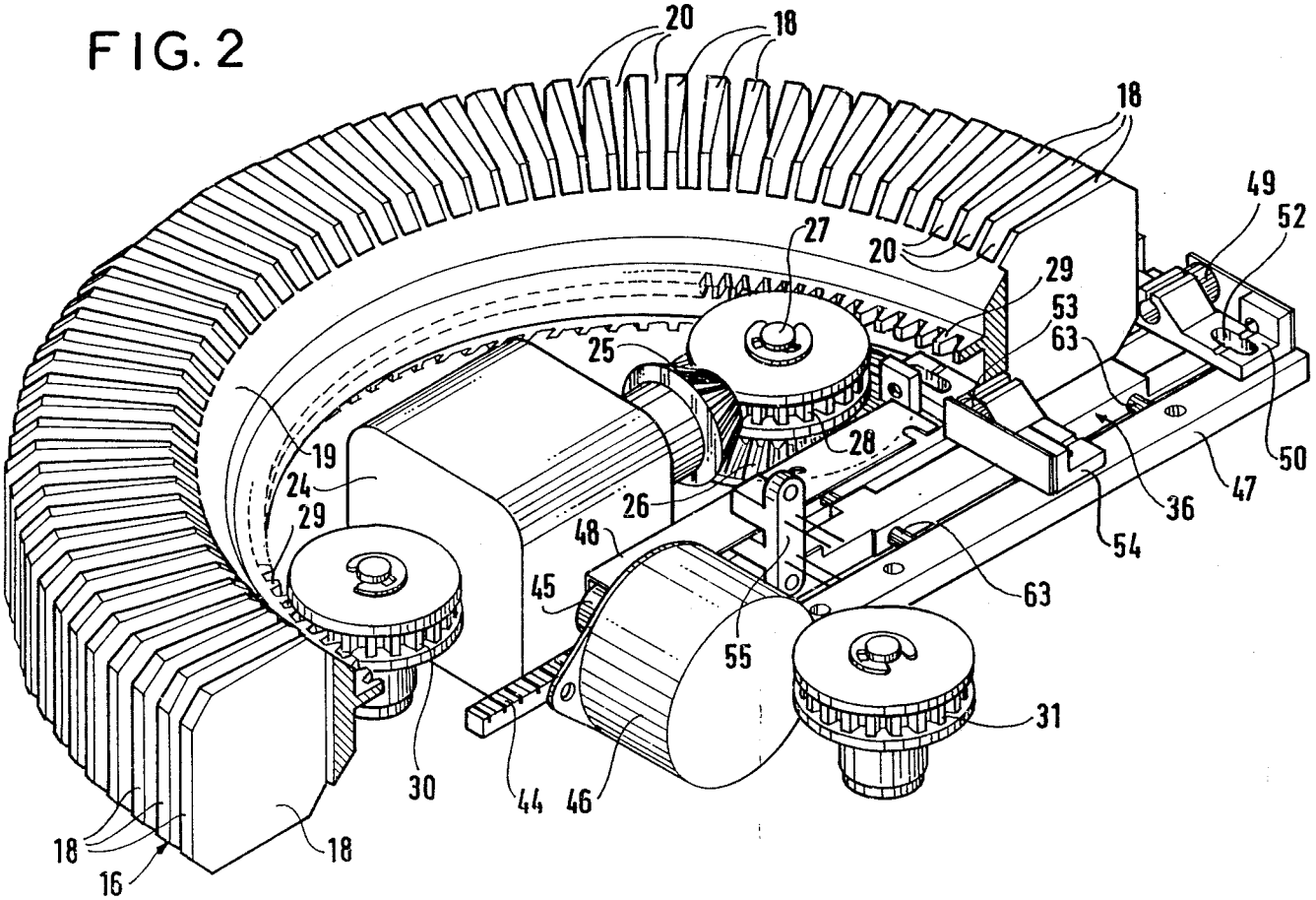
FIG. 2 is a partial perspective view of a buffer coin box or coin store loading magazine and the mechanical parts linked to the cartridge not shown in the figure, housing the magazine.
Figure 3:
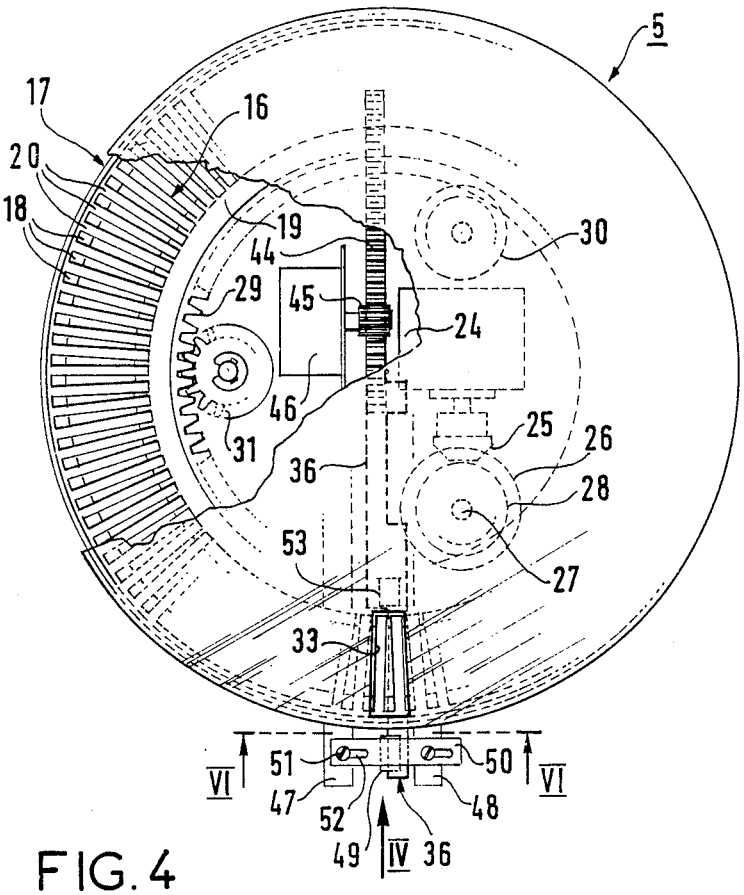
FIG. 3 shows the buffer box or a coin store, i.e. a complete coin handling stage, including the magazine in its cartridge.
Figure 4:
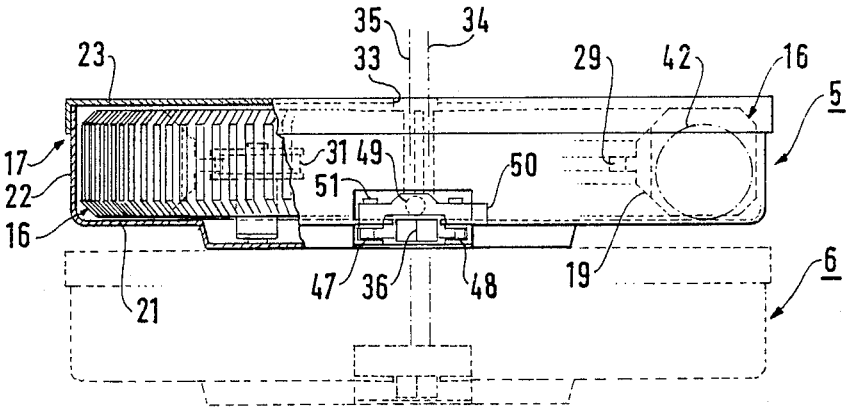
FIG. 4 is a view along arrow IV of FIG. 3.
Figure 7A:
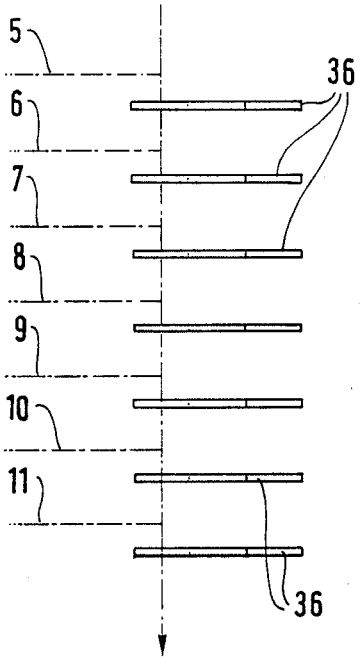
FIGS. 7A–D diagram the position of the coin handler's bolts when the former is at rest and de-energized.
Figure 7B:
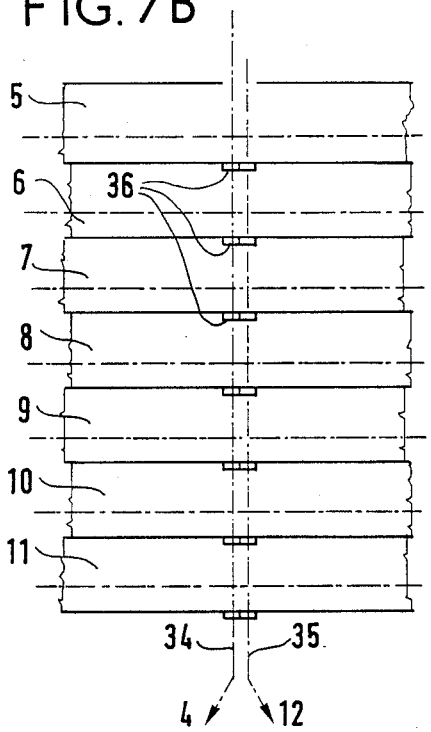
Figure 7C:
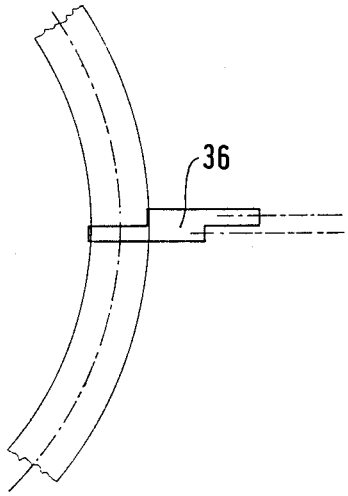
Figure 7D:
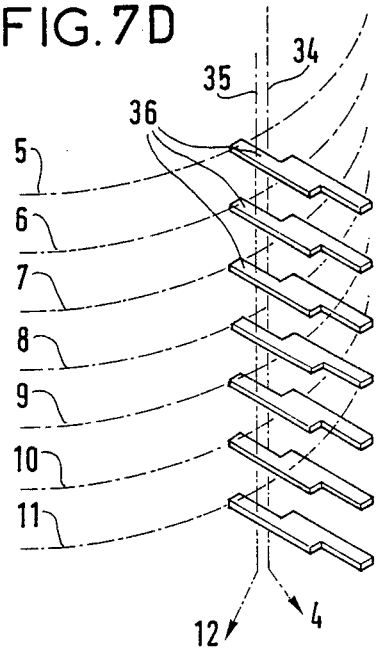
Figure 8A:
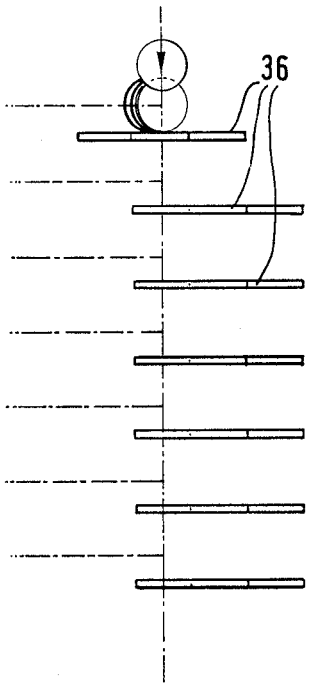
FIGS. 8A–D illustrate the operation of the coin-handler in its function of acquiring coins in the buffer coin box.
Figure 8B:
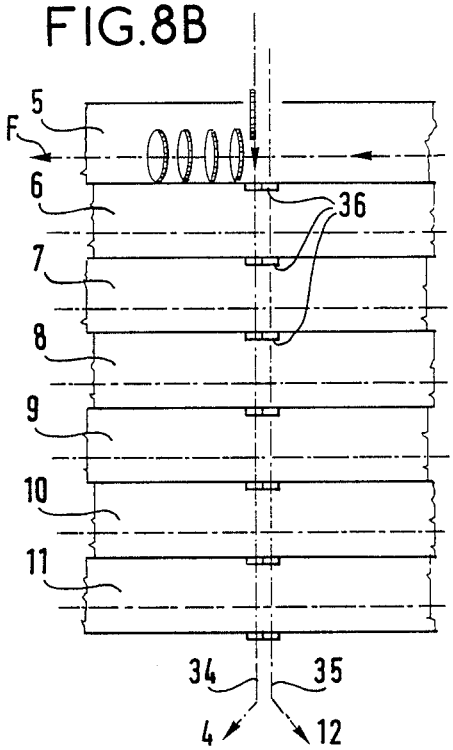
Figure 8C:
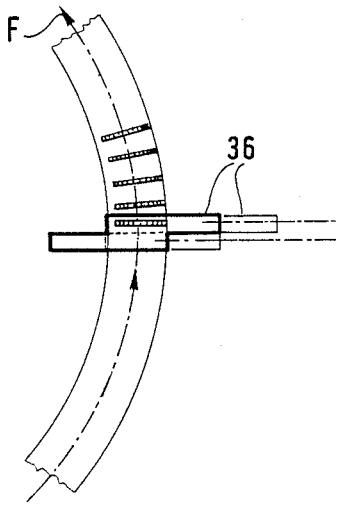
Figure 8D:
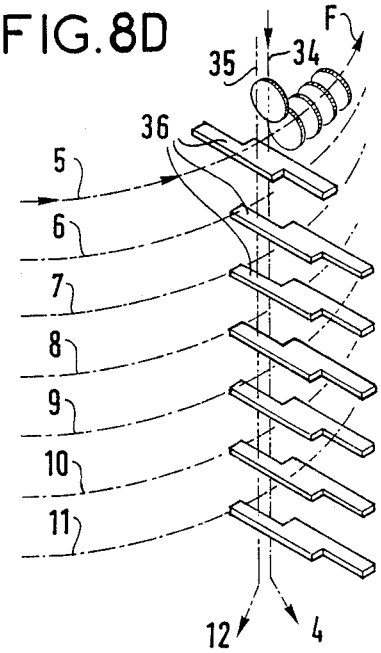
Figure 9A:
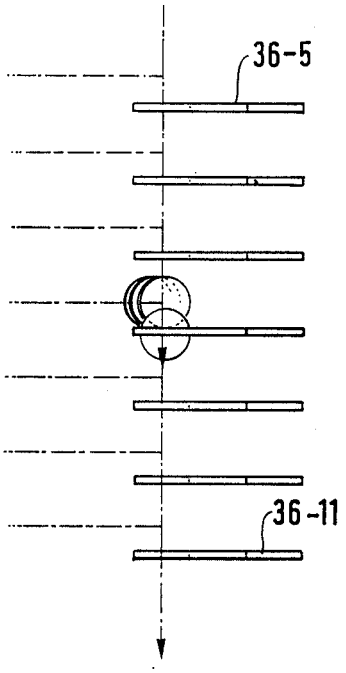
FIGS. 9A–D illustrate a coin return from store number 8.
Figure 9B:
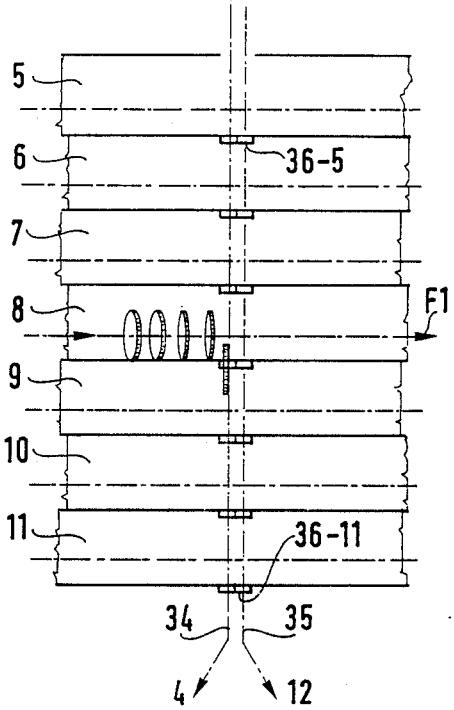
Figure 9C:
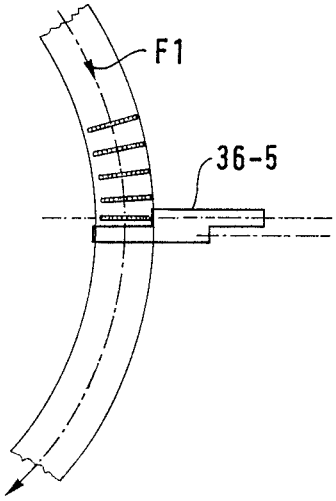
Figure 9D:
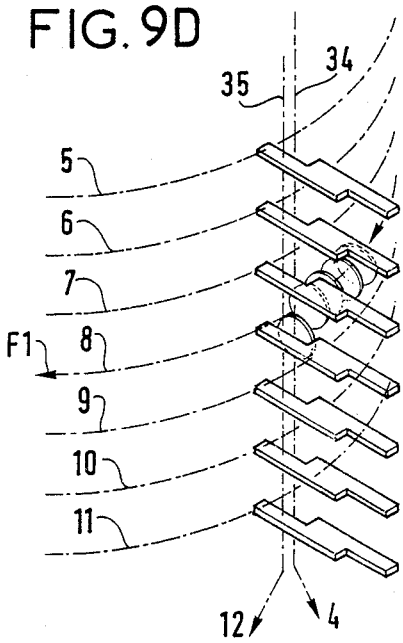
Figure 10A:
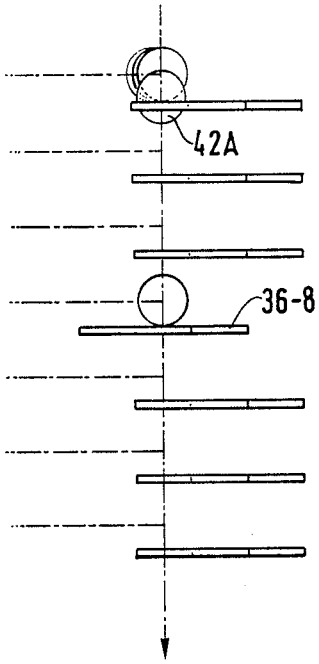
FIGS. 10A–D illustrate the storing in store number 8 of a coin from buffer box 5.
Figure 10B:
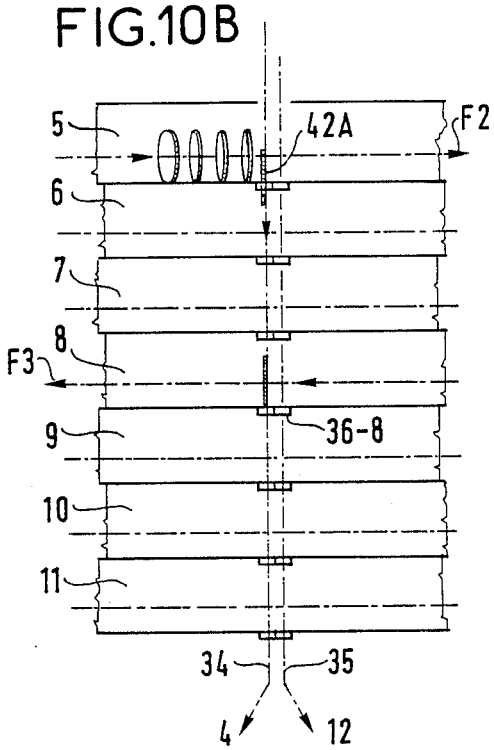
Figure 10C:
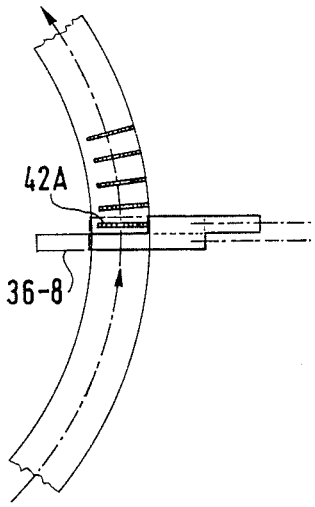
Figure 10D:
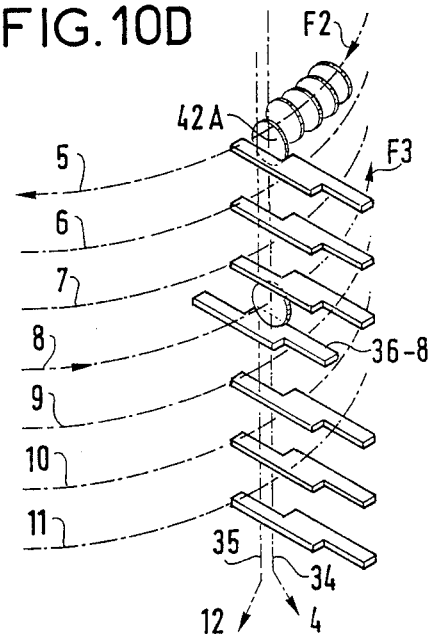
Figure 11A:
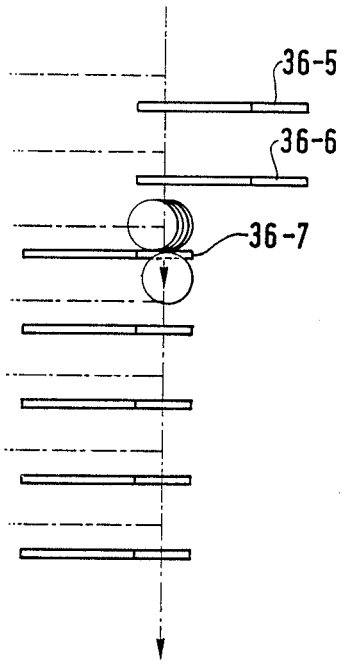
FIGS. 11A–D illustrate the collection of coins coming from filled store number 7.
Figure 11B:
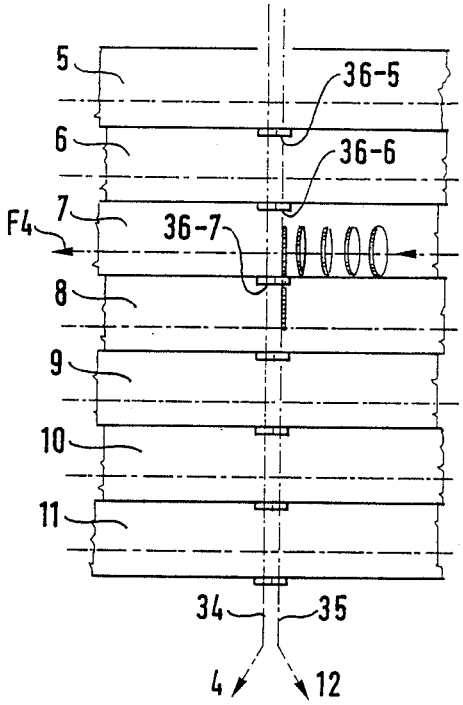
Figure 11C:
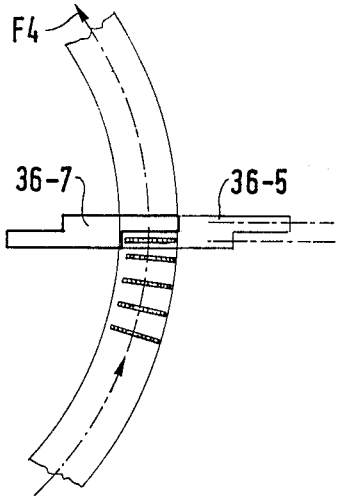
Figure 11D:
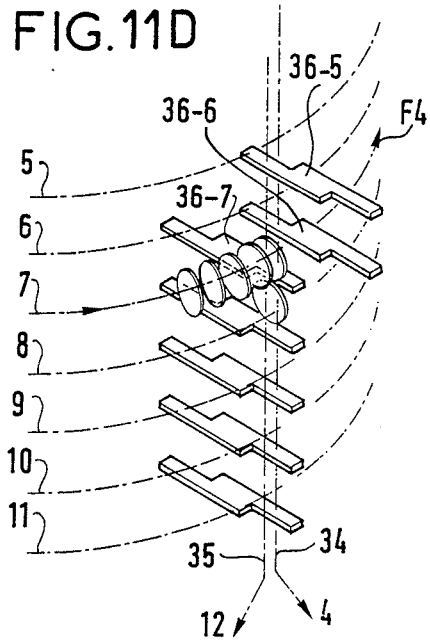

Referring now to FIGS. 2, 3 and 4, the buffer box 5 and store 6 through 11 will be described. For easier description, the term buffer 5 will be used to refer to both items.

As can be seen, then, buffer 5, basically a circular deck, comprises a loading magazine 16 disposed in a stationary cartridge 17.

The magazine 16 consists of a circular crown with radial, vertical walls 18, connected together on the inside by a connecting wall 19 and with their outermost radial ends free, which walls in pairs bound individual cells 20 accommodating coins. The magazine has neither a bottom nor a top and thus appears as a sort of circular comb. Magazine 16 comprises P+2 cells 20, one hundred and two cells for example, for storing P coins, and specifically one hundred coins in the selected example.

The magazine is thus disposed in the stationary cartridge 17 which has a bottom 21, a circular side wall 22 and also, in the example described, a cover 23, making it possible to remove and carry away from the dispenser the buffer or a store, even one filled with coins.

The cartridge 17 includes means for indexably rotatively driving the loading magazine 16 within its cartridge 17. Said means consist of a stepping motor 24 the drive shaft whereof is equipped with a bevel gear 25 that meshes with a bevel gear 26 whose shaft 27 is secured in the bottom of the cartridge.

The shaft 27 moving with bevel gear 26 also carries a pinion 28 which meshes with a toothed wheel 29 attached to the connecting wall 19. To ensure correct centering of the loading magazine 16 in the cartridge 17, two other pinions 30 and 31 also mesh with the toothed wheel 29. The respective shafts of the three gears 28, 30 and 31 are located 120 degrees from one another around the axis of the buffer box.

The portion of the bottom 21 of the cartridge 17 located beneath the cells 20 is given a radial opening 32, visible in FIG. 8 and FIG. 4, to which corresponds a similar opening 33 in the cover 23, visible in FIG. 3.

These radial openings 32 and 33 made respectively in the bottom and cover of the cartridge 17 have a circumferential width equal to two consecutive cells 20. The openings 32 and 33 of all the stores 6 to 11 and of the buffer box 5 are exactly aligned vertically. The loading magazine drive motors 24 always stop the magazines in a position where two consecutive cells 20 are perfectly centered in front of the openings 32, 33, thus forming, when the bolts described hereinafter are disengaged, two open vertical channels or chutes 34 and 35 allowing the coins brought into vertical alignment, by rotation of the magazine, with one or the other of these chutes, to drop into the tray 4 (in the case of chute 34) or the coin box 12 (in the case of chute 35), or only as far as any of the lower stores having its opening 32 closed off by the hereinafter described bolt.

In the following description, the chute 34 will be termed the first column of cells and the chute 35 the second column of cells, it being understood that said cell columns or vertical alignments 34 and 35 are always present but are not always formed of the same cells, since the magazines may rotate in their respective cartridges and the chutes formed by the vertical alignments of cells may at different times be or not be obstructed by bolts through the opening 32 in the bottom of each store and of the buffer box. The outlet from selector 3 debouches above the opening 33 of the buffer 5, in vertical alignment with the first column 34 of cells 20.

The opening 32 in the bottom of each cartridge is associated with a bolt 36, drawn to a large scale in FIGS. 5A, B and C and viewed from the end in FIG. 6, which can occupy three different positions to either block off cartridge bottom 21 opening 32 completely, by means of the bolt's center portion 39 (FIG. 5B), or only partly close off said opening (FIGS. 5A and C). In the position illustrated in FIG. 5A, the bolt 36, by means of its portion 37 furthest from the center of the cartridge, blocks off the part of opening 32 corresponding to the chute or first column 34, i.e. the chute leading to the coin return tray 4.

In the position illustrated in FIG. 5C, the bolt 36, by means of its portion 38, blocks off the part of opening 32 corresponding to the chute or second column 35, i.e. that leading to the coin collection box 12.

As can be readily seen from FIG. 6, the top surface 40 of cartridge bottom 21 and the top surface 41 of the bolt 36 are exactly at the same level so as to allow coins to pass unhindered, by sliding on this bottom 21, from the bottom 21 onto the bolt 36 or vice versa, when the coins are conveyed along by the rotation of the magazine 16.

FIGS. 5A and 6 show a coin 42 in a cell identified by the numeral 20A. There being no bottom to retain this coin 42, due to the position of the bolt, the coin drops, as indicated by the arrow 43, into the next store where it will either remain or not, depending on the position of the bolt in that magazine.

For movement purposes, the bolt 36 is provided with an extension towards 44 the inside carrying a toothed rack that meshes with a pinion 45 rotatively driven by a motor 46 connected to the bottom 21 of the cartridge.

For bolt guidance purposes, the bolt 36 is also provided with guide pins 63 slidable in channel sections 47 and 48. The pins 63 are omitted from FIGS. 5A, B and C.

The stationary portion of the buffer box and stores also comprises an electro-optical detector of the position of magazine 16 relative to the stationary cartridge 17. This detector comprises an electro-optical source 49 mounted on a bracket 50 attached to the channel sections 47 and 48 by means of screws 51 inserted through oblong holes 52 allowing the position of the source 49 to be adjusted, and a receiver 53 also mounted on a bracket 54 attached to the channels 47 and 48. Each cartridge further comprises a bolt position detector 55.

The motors 24 and 46 as well as the detectors 49, 53 and 55 are electrically connected to electronic and computer control circuits for the dispenser as a whole.

To prevent the introduction of certain objects that might jam the coin handler, the coin slot 2 is immediately followed by a first coin presence detector 60 controlling the opening of a flap, 61 which detector is followed by a second detector. Together, these two detectors 62 make it possible to check the direction of coin travel and to prevent some types of fraud. The first detector, controlling the flap, prevents the insertion of non metallic objects or of metal objects not recognized as coins, such as paper clips for instance.

These control devices have been omitted from the drawings.

Referring now to FIGS. 7 through 11, which are merely rough diagrams, the operation of a dispenser according to the invention will now be described.

In the just-mentioned figures, the buffer box and stores are labeled with the same numerals as in the previous figures, namely the numerals 5 to 11.

The views B of FIGS. 7 to 11 are from the axis of the dispenser toward the bolts 36, which explains why the reference numerals 34 and 35 are reversed when moving from the B views to the D views of FIGS. 7 through 11.

The views C in these same figures are top views of the A representations.

The FIGS. 7 correspond to a power off condition of the dispenser or to a condition where a coin not in a category recognized and accepted by the coin handler selector 3 has been inserted in the coin slot. In this case, all the bolts 36 are in a position not obstructing the chute 34, such that the unrecognized coin drops directly into the coin return tray 4.

The FIGS. 8 illustrate the acquisition of coins: the user sees the displayed price of his/her purchase and the coin handler is waiting to receive the coins. The bolt 36 of the buffer box 5 is in median position, meaning that it blocks off both chutes 34 and 35. The coin drops into buffer 5, into a cell 20 forming part of chute 34.

At each drop of a coin, the buffer is indexed one step ahead in the direction indicated by the arrows F, in other words in a counterclockwise direction as seen from above.

If a coin is not recognized as valid by the selector 3, the both 36 of buffer 5 returns to the position represented in the FIGS. 7 and the coin drops into the return tray.

As soon as the displayed amount is reached, the service is delivered and change is immediately returned if the value of the last inserted coin causes the requested sum to be exceeded.

The FIGS. 9 illustrate the process of coins being returned from store 8, which contains only coins of a single predetermined value or denomination.

The bolt 36 of buffer 5, labeled 36-5, has resumed its position in which the chute 34 is open, such that any further coin placed in the coin slot will drop directly into the return tray 4.

In order to return change from store number 8, the loading magazine of said store 8 is indexed one step clockwise, in the direction of arrows F1, i.e. in the opposite direction from the rotation of the magazine of buffer 5 during coin acquisition, thus taking a coin from store 8 into vertical alignment with chute 34 and allowing it to drop into the tray 4.

On completion of the sale, the coins, temporarily stored in buffer 5, are distributed to the different stores 6 through 11, according to their denomination. FIGS. 10 illustrate a distribution-to-stores operation wherein the last inserted coin 42A is stored in store 8. This occurs when the bolt 36-8 is actuated to intermediate position and the buffer 5 is indexed back by one cell (arrows F2, clockwise and the reverse of the acquisition process). Once the coin has dropped into store 8, this store's magazine is indexed one step forward in the direction of acquisition (arrows F3).

If a coin from the buffer must be sent, in accordance with its denomination, to an already filled up store, in other words a store all of whose cells are occupied except the two corresponding to the chutes 34 and 35, the control system actuates the bolt of the given store, say store 7 for example, illustrated in FIGS. 11, to its intermediate position, then indexes back the buffer by one cell. The said coin thus drops to store 7, into the cell corresponding to chute 34; the magazine of store 7 then advances one step in the acquisition direction (arrow F4), which places a coin in that store in vertical alignment with chute 35, since the store is full.

The bolt 36 of store 7 is then actuated to the position shown in FIG. 5A, opening chute 35 as well as all the bolts of the lower decks (stores 8 through 11).

The coin thus drops directly in the coin collection box 12.

In the event the user cancels his/her order before having inserted the amount of coins required for the desired purchase, cancellation being obtainable by means of a cancel button, the bolt of buffer 5 returns to fully extended position, or otherwise stated, in the same position as all the other bolts (FIG. 7) and the buffer magazine steps back by as many steps as the number of coins already introduced by the user.

Once the amount of the displayed purchase price has been reached, it is no longer possible to cancel.

With this device, and assuming the dispenser accepts only payment in coins, the number of stores in one less than the number of coins accepted by the selector 3. In effect, the highest-valued coin accepted by the selector will never have to be returned in change and will always be dropped directly into the coin collection box 12. However, the dispenser may include a note recognition and acceptance device separate and distinct from the coin changer just described, yet also tied in to the overall control electronics, and in this case all the denominations of accepted coins are used to make change and the number of stores is equal to the number of different coin denominations accepted.

We claim:

1. An automatic dispenser and coin changer comprising: a case, a single slot within said case for inserting coins, a chute to guide the coins extending from said slot to an entry to a selector, a buffer coin box, N coin stores within said case, a coin collection box and a coin return tray within said case beneath said N coin stores, the buffer box and each coin store having a bottomless and topless loading magazine, shaped as a circular crown with a vertical axis, comprising P+2 radial cells bounded by radial, vertical walls, said circular crown being arranged in a stationary cartridge having at least a bottom and a circular side wall, the buffer and each coin store having a stepping motor to rotatively drive said loading magazine within each cartridge, the N stores being placed coaxially one below another beneath the buffer, the bottom of each cartridge being provided with a radial opening beneath said cells, said opening extending over a circular width corresponding to two cells of said loading magazine, said openings in all said cartridges being all vertically aligned, means for stopping each loading magazine motor to position its associated magazine always with two consecutive cells located in front of said opening, said selector having an outlet located in front of a first column of cells of the buffer box and of the N stores enabling a coin to drop from said selector into said coin return tray, through said openings, a second, consecutive column of cells of the buffer box and stores enabling a coin to drop from said buffer into said coin box through said openings, each cartridge being equipped with a bolt at said opening, a control motor operative coupled to each said bolt for enabling the bolt to assume a first position completely blocking said opening, a second position blocking a portion of said opening corresponding to said first column of cells and a third position blocking the other portion of said opening corresponding to said second column of cells, and each cartridge comprising means for detecting the position of the loading magazine and the bolt.

2. Dispenser according to claim 1, wherein each cartridge further comprises a top cover having an opening vertically aligned with the said bottom opening thereof.

3. Dispenser according to claim 1, wherein the buffer coin box and the stores are interchangeable.

4. Dispenser according to claim 1, wherein, the coin slot is followed by a closing flap, said flap being preceded by a first coin presence detector operatively connected to said flap for controlling the flap's opening and followed by a second detector, said first and second detectors enabling the direction of coin travel to be checked.

5. A process for using a dispenser comprising: a case a single slot within said case for inserting coins, a chute to guide the coins extending from said slot to an entry to a selector, a buffer coin box, N coin stores within said case, a coin collection box and a coin return tray within said case beneath said N coin stores, the buffer box and each coin store having a bottomless and topless loading magazine, shaped as a circular crown with a vertical axis, comprising P+2 radial cells bounded by a radial, vertical walls, said circular crown being arranged in a stationary cartridge having at least a bottom and a circular side wall, the buffer and each coin store having a stepping motor to rotatively drive said loading magazine with each cartridge, the N stores being placed coaxially one below another beneath the buffer, the bottom of each cartridge being provided with a radial opening beneath said cells, said opening extending over a circular width corresponding to two cells of said loading magazine, said openings in all said cartridges being all vertically aligned, means for stopping each loading magazine motor to always position its associated magazine with two consecutive cells located in front of said opening, said selector having an outlet located in front of a first column of cells of the buffer box and of the N stores enabling a coin to drop from said selector into said coin return tray, through said openings, a second, consecutive column of cells of the buffer box and stores enabling a coin to drop from said buffer into said coin box through said openings, each cartridge being equipped with a bolt at said opening, a control motor operatively coupled to each said bolt for enabling the bolt to assume a first position completely blocking said opening, a second position blocking a portion of said opening corresponding to said first column of cells and a third position blocking the other portion of said opening corresponding to said second column of cells, and each cartridge comprising means for detecting the position of the loading magazine and the bolt, said process comprising the steps of depositing one by one all the coins inserted by the user and recognized and accepted by the selector, regardless of their category, in consecutive cells of the buffer box, by successive, stepped rotation of the loading magazine in the cartridge of the buffer box, and delivering the service or product, returning the due change strictly from the different stores, and emptying the buffer box into the different stores, with each store being assigned to handle a single category of coins.

* * * * *